US005423623A

United States Patent [19]

Bakic

[11] Patent Number: 5,423,623

[45] Date of Patent: Jun. 13, 1995

[54] COSMETIC PENCIL WITH REPLACEABLE PART

[75] Inventor: Dieter Bakic, München, Germany

[73] Assignee: Dieter Bakic Design S.r.l., Milan, Italy

[21] Appl. No.: 88,329

[22] Filed: Jul. 7, 1993

[30] Foreign Application Priority Data

Jul. 10, 1992 [DE] Germany ..... 42 22 759.3

[51] Int. Cl.[6] ..... B43K 21/10; B43K 21/08; A45D 40/06

[52] U.S. Cl. ..... 401/70; 401/75; 401/68; 401/78

[58] Field of Search ..... 401/62–64, 401/68, 55, 70, 58, 75, 78, 116

[56] References Cited

U.S. PATENT DOCUMENTS

| | | | |
|---|---|---|---|
| 1,574,457 | 2/1926 | Wahl | 401/70 |
| 3,106,908 | 10/1963 | Gretz | 401/70 X |
| 3,197,024 | 7/1965 | Abu | 401/75 |
| 3,358,699 | 12/1967 | Bau | 401/70 |
| 5,018,892 | 5/1991 | Krueckel et al. | 401/78 X |

FOREIGN PATENT DOCUMENTS

| | | | |
|---|---|---|---|
| 1196278 | 11/1959 | France | 401/75 |
| 3728427 | 12/1988 | Germany . | |

*Primary Examiner*—Danton D. DeMille
*Attorney, Agent, or Firm*—Parmelee, Bollinger & Bramblett; George W. Rauchfuss, Jr.

[57] ABSTRACT

The invention relates to a cosmetic pencil with a pencil base (1) and a replaceable part (2). The pencil base (1) comprises a tube (10), a spindle (7) with a tip and a spring (9) which is arranged on the spindle (7) and the tube (10) such that the spindle (7) is pressed or pulled into the tube (10). The replaceable part (2) has an essentially annular cosmetic guide (5) and a cosmetic holder (4), at the one end of which a bar-shaped cosmetic (3) can be attached and which can be shifted axially in the cosmetic guide (5). The pencil base (1) and the replaceable part (2) can be coupled such that they can be rotated in opposite directions, wherein the cosmetic holder (4) can be shifted away from the tip of the spindle (7). A spiral means is designed at the periphery of the spindle ( 7 ) . A gripping means ( 6 ) is preferably arranged at the cosmetic guide (5). When the pencil base (1) and the replaceable part (2) are coupled, the gripping means (6) can be engaged with the spiral means of the spindle (7). (FIG. 1)

2 Claims, 4 Drawing Sheets

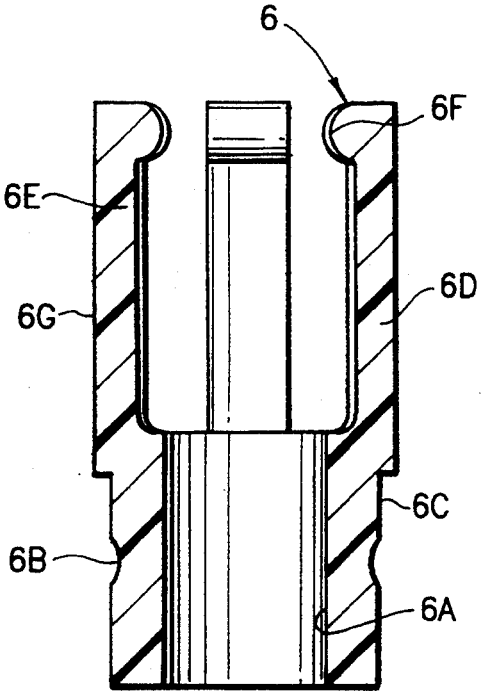
FIG. 7
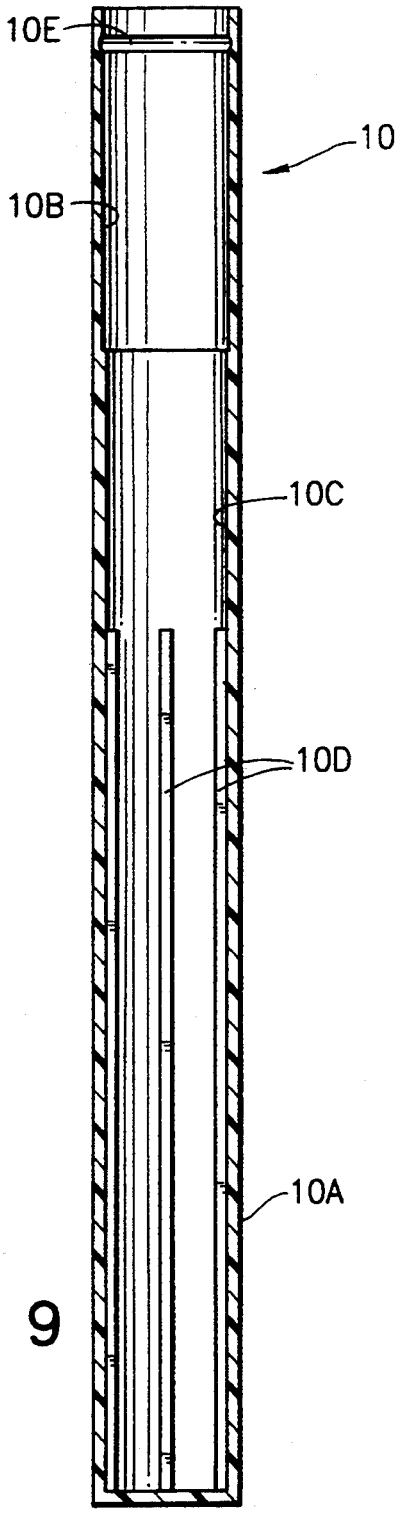
FIG. 9
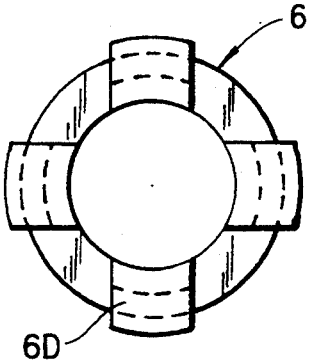
FIG. 8
FIG. 10
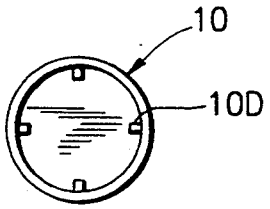

COSMETIC PENCIL WITH REPLACEABLE PART

FIELD OF THE INVENTION

1. Technical Field

The invention relates to a cosmetic pencil with a replaceable part. The replaceable part can comprise in particular bar-shaped, solid or pasty cosmetics, e.g of a variety of colors or for a variety of purposes,. If the replaceable part is placed upon a pencil base and these two elements are rotated in opposite directions the cosmetic in the replaceable part is shifted continuously out: of the replaceable part.

2. Description of Related Art

A cosmetic pencil with a replaceable part is known, e.g. from U.S. Pat. No. 4,997,229, wherein a replaceable part is inserted into a body and can be removed from this body. For this, an inner cylinder comprises a spiral groove over its inner surface and is arranged inside the body. Furthermore, a push rod is provided which moves in an axial direction inside the inner cylinder under the guidance of the spiral groove and which comprises webs axially on its outer surface. The body further comprises a spring which pushes the push rod back into the inner cylinder. The replaceable part has a chuck which holds a cosmetic and comprises axial grooves. Thus, the chuck can be inserted into a guide cylinder inside the replaceable part which can in turn be placed in an axial direction into the body. A second spring pushes the chuck and the cosmetic into the innermost position in the replaceable part. In the guide cylinder axial grooves are provided which guide the chuck axially. When coupling the replaceable part with the body these elements can be rotated in opposite directions and the slide rod is coupled with the chuck such that it cannot be rotated by its axial webs engaging with the grooves in the chuck in order to guide the cosmetic on the chuck out of the aperture at the tip of the replaceable pencil when the replaceable part and the body are rotated in opposite directions.

The known cosmetic pencil requires a complex structure with a plurality of components, e.g. two springs, and is therefore difficult and expensive to produce and to assemble.

SUMMARY OF THE INVENTION

The object underlying the invention is to overcome the above drawbacks.

This object is achieved with a cosmetic pencil having the features of claim 1 and/or claim 2. The dependent claims are directed to preferred embodiments of the invention.

The subject-matter of claim 1 is based on the idea of a gripping means on a replaceable part engaging with a spiral groove designed on a spindle when a pencil base and the replaceable part placed thereon are rotated in opposite directions. When the two elements are rotated, the spindle is moved forward, thereby continuously moving a cosmetic holder with a cosmetic out of the replaceable part in an essentially axial direction.

The subject-matter of claim 2 is based on the idea of requiring merely one spring for assembly of the replaceable part and the pencil base up to the time when these elements are detached, by means of a non-positive or positive connection of the spindle and the cosmetic holder. The spring pushes the spindle back into the pencil base and thus also the cosmetic holder with the cosmetics in the retracted state into the replaceable part.

A preferred embodiment of the invention combines the features of claims 1 and 2.

BRIEF DESCRIPTION OF THE DRAWINGS

The objects, advantages and features of the invention will be explained in more detail below by means of examples and with reference to the drawings.

FIG. 7 shows a longitudinal section which is not to scale of a thread segment of the replaceable part according to FIG. 1, FIG. 8 shows a top view of the thread segment according to FIG. 7, FIG. 9 shows a longitudinal section which is not to scale of a tube of the pencil base according to FIG. 1, FIG. 10 shows a top view onto the tube according to FIG. 9.

DETAILED DESCRIPTION OF PREFERRED EMBODIMENTS

Figure 1:
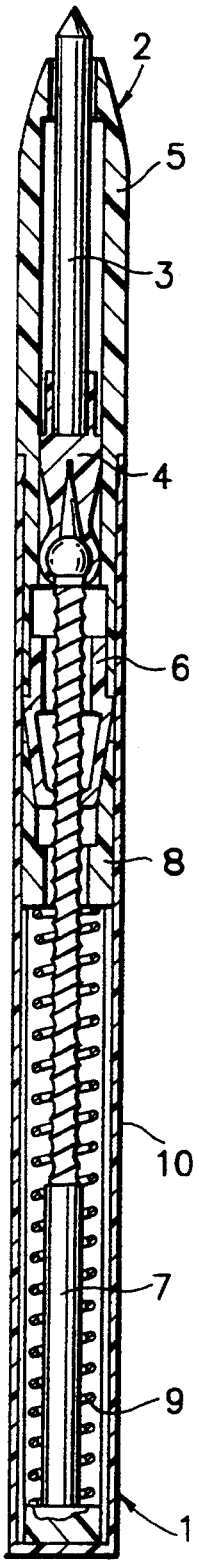
FIG. 1 shows an enlarged longitudinal section of an embodiment of a cosmetic pencil with a replaceable part according to the invention, wherein the replaceable part is placed onto the pencil base.
Figure 2:
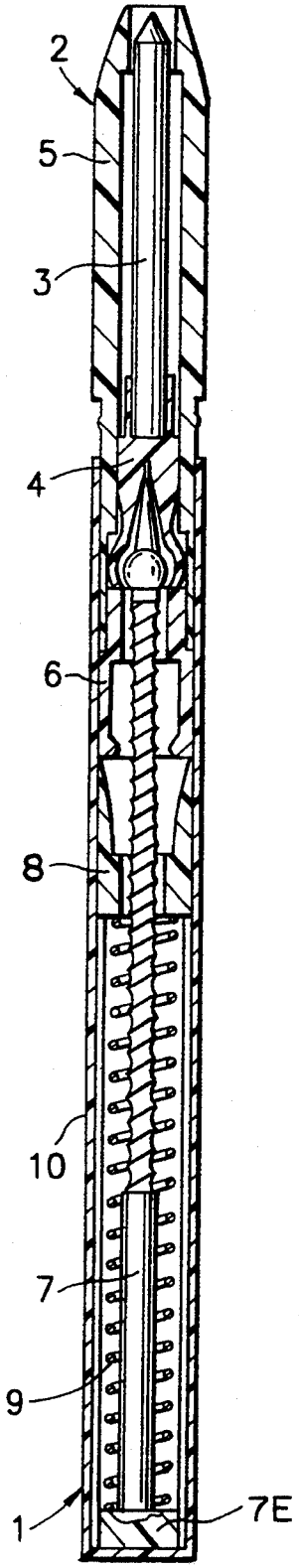
FIG. 2 shows a longitudinal section of the embodiment according to FIG. 1, wherein, however, the replaceable part is not completely placed onto the pencil base.

The cosmetic pencil of the invention according to FIGS. 1 and 2 comprises an oblong pencil base 1 and an oblong replaceable part 2. The outer length of the pencil base 1 and that of the replaceable part 2 are preferably in a ratio of approximately 2:3. The replaceable part 2 can be placed into or onto the pencil base according to FIG. 1 or removed from this according to FIG. 2. When assembled the two elements 1, 2 can be rotated in opposite directions.

The replaceable part 2 comprises a cosmetic 3, which is designed in particular in the form of a pencil and has a free end, a cosmetic holder 4 at the other end of the cosmetic 3, a cosmetic guide 5 and a thread segment 6. The cosmetic guide 5 can be of an essentially tubular design and surrounds the cosmetic 3 when this is in the retracted state. In a preferred embodiment the cosmetic guide 5 further surrounds the cosmetic holder 4 and possibly at least part of the thread segment 6. The cited elements of the replaceable part 2 are preferably aligned coaxially to one another.

The pencil base 1 comprises a spindle 7 arranged therein with a spindle base 7E, a clamping piece 8, a spring 9 arranged between the clamping piece 8 and the base 7E of the spindle 7, and a tube 10. The tube 10 which is closed at one end preferably surrounds the other elements of the pencil base 1. These elements can be arranged coaxially. The replaceable part 2 is placed onto or into the open end of the tube 10. The spindle 7 with its spindle base 7E is supported at the closed end of the tube 10. The pencil base 1 can be coupled with the replaceable part 2 between the tube 10 and the replaceable part 2 in a frictional engagement or preferably positively or non-positively. The connection of the two elements 1, 2 should enable the elements 1, 2 to be rotated and easily detached.

Figure 3:
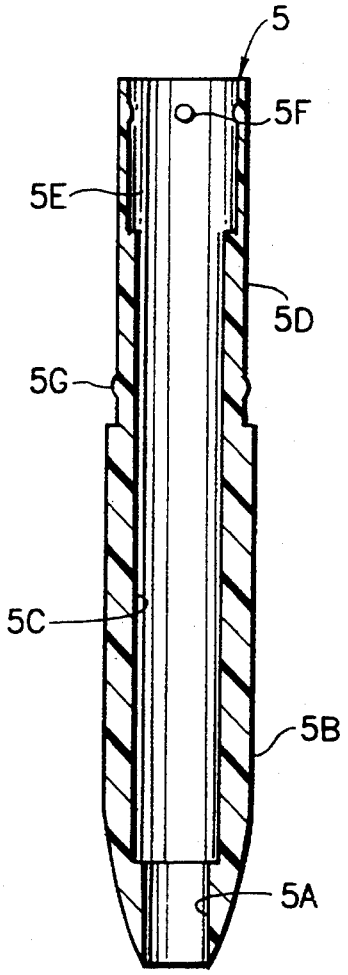
FIG. 3 shows a longitudinal section which is not to scale of a cosmetic guide of the replaceable part according to FIG. 1.

FIG. 3 shows the cosmetic guide 5 of the embodiment of the invention described above. However, the cosmetic guide is aligned inversely to that in FIGS. 1 and 2. It is essentially tubular, preferably consists of plastic ABS-SAN and comprises a bore 5A at its tip, the diameter of which is preferably greater than or identical to the outer diameter of the cosmetic so that the cosmetic 3 can, on the one hand, be guided by the bore 5A and, on the other hand, be easily shifted axially therein. An outer diameter 5B of the cosmetic guide 5 is tapered to the tip for aesthetic reasons so that a spherical surface is formed up to the tip. The bore 5A at the tip of the cosmetic guide 5 coaxially adjoins a bore 5C which is preferably approximately 30% greater and more preferably approximately 6 times longer than the bore 5A, the cosmetic holder 4 being able to be shifted in an axial direction in bore 5C. A bore 5E adjoining the bore 5C and preferably approximately 25% greater and more preferably approximately 4 times shorter than bore 5C is provided at the end of the cosmetic guide 5 opposing the tip, wherein preferably at least a part of the clamping piece 8 can be introduced into bore 5E. The end opposing the tip of the cosmetic guide 5 has an outer diameter 5D which can be smaller than diameter 5B so that the end of the cosmetic guide opposing the tip can be introduced into the pencil base 1 essentially up to the end of the length with the outer diameter 5D. Furthermore, at least one projection 5F can be designed at this end in the bore 5E, preferably four in the form of a segment of a sphere, at right angles to the longitudinal axis of the cosmetic guide 5. By means of the projections 5F with e.g. a radius of approximately 1 mm the thread segment 6 can e.g. be fixed to the cosmetic guide. In addition, an essentially annular bead 5G can be designed on the outer diameter 5D, which facilitates a positive or non-positive connection with a suitable means to the pencil base 1 so that the pencil base 1 and the replaceable part 2 quasi lock into place when they are assembled and can be rotated in opposite directions.

Figure 5:
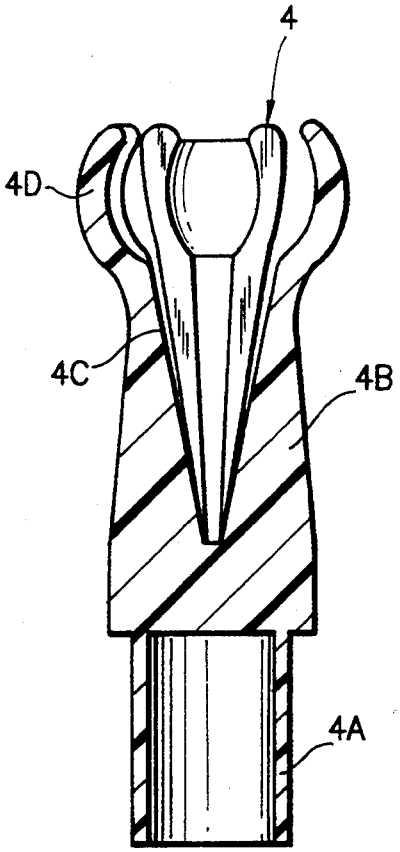
FIG. 5 shows a longitudinal section which is not to scale of a cosmetic holder of the replaceable part according to FIG. 1.
Figure 4:
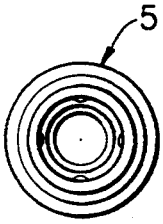
FIG. 4 shows a top view of the cosmetic guide according to FIG. 3.
Figure 6:
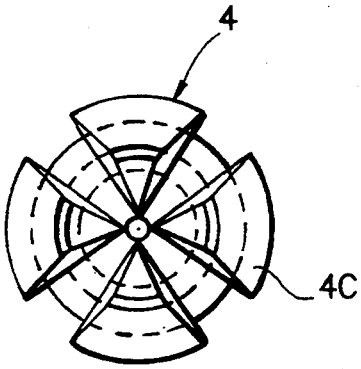
FIG. 6 shows a top view of the cosmetic holder according to FIG. 5.

FIG. 5 shows the cosmetic holder according to the embodiment in FIGS. 1 and 2 (turned about an angle of 180°), preferably made of POM. An open end 4A can be cup-shaped in order to receive an end of the cosmetic 3. The outer diameter of the end 4A is preferably somewhat smaller than the diameter of the bore 5A at the tip of the cosmetic guide 5. This enables the end 4A to be guided into the diameter 5A of the cosmetic guide 5 even when the cosmetic 3 is fully drawn out of the replaceable part 2. An at least partially closed section 4B adjoins the open end 4A. Essentially radially elastic arms 4D extend from the section 4B. There are preferably four arms which are preferably designed at their free ends in the form of a segment of a sphere. By means of a recess 4C in the section 4B which increases in size in the direction of the free ends of the arms 4D with a notch angle of approximately 24° in an unstressed state, a radial elasticity of the arms 4D is guaranteed. When the arms 4D are in an unstressed state their radial external dimension preferably essentially corresponds to the diameter of the bore 5E of the cosmetic guide 5. In the inward elastic, stressed state, the free ends of the arms 4D form a part of a spherical shell, the outer diameter of which should be no greater than the diameter of the bore 5C of the cosmetic guide 5. All further radial external dimensions of the cosmetic holder 4 likewise should not exceed this dimension.

At the opposite end of the tip of the cosmetic guide 5 a thread segment, preferably made of POM, can be fixed according to FIG. 7. The end of the thread portion 6 which is directed to the cosmetic guide 5 preferably has an outer diameter 6C which can be smaller than or identical to the diameter of the bore 5E of the cosmetic guide 5 in order to be able to at least partially introduce this end of the thread portion 6 into the bore 5E. At least one indentation 6B is provided on the outer periphery, preferably four in the form of a trough, with essentially the same radius as projections 5F, by means of which the thread segment 6 can be arranged non-positively or positively, by the projections 5F engaging into the indentations 6B in the cosmetic guide 5, such that it cannot be rotated. At this end of the thread segment 6 there is a bore 6A. At the other end of the thread segment 6 radially elastic segment arms 6E extend in an essentially axial direction, preferably four which each have at their end an undercut claw 6F, which is convex in cross section and can be engaged with a spiral groove 7C of the spindle 7.

In unstressed state these preferably have a constant external dimension 6G. It can be seen in the top view according to FIG. 8 that the inner surfaces on the claws 6F which engage with the spindle are designed as concave segments of a circle as seen from above.

According to FIG. 9, the tube 10 preferably consisting of the plastic ABS-SAN has an outer diameter 10A which preferably essentially corresponds to the greatest diameter 5B of the cosmetic guide 5. An inner diameter 10B is somewhat greater than the outer diameter 5D of the cosmetic guide 5 and somewhat longer than this so that the cosmetic guide 5 can be introduced into the open end of the tube 10. An inner diameter 10C adjoins the outer diameter 10B towards the closed end of the tube 10, said inner diameter 10C being identical to or preferably smaller than the diameter 10B. On a further preferred embodiment the diameter 10C is somewhat greater than the external dimension 6G of the thread segment 6 so that this in assembled state can be pushed with the replaceable part 2 into the area of the diameter 10C during assembly. Webs 10D, preferably four, are designed axially on the diameter 10C from the lower closed end of the tube 10 to somewhat more than halfway along the entire length of the tube 10. An annular groove 10E of the tube 10 in the area of the diameter 10B can be engaged with the bead 5G of the cosmetic guide 5 when the elements 1, 2 are assembled so that these can be rotated in opposite directions and can be held axially once assembled.

Figure 11:
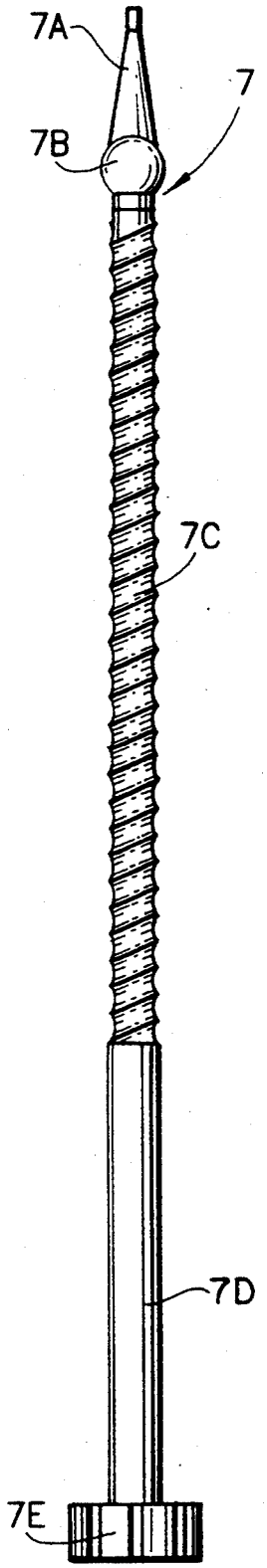
FIG. 11 shows a side view which is not to scale of a spindle of the pencil base according to FIG. 1.
Figure 12:
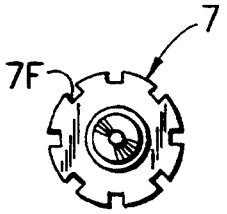
FIG. 12 shows a top view of the spindle according to FIG. 11

The spindle according to FIG. 11 is preferably made of the plastic ABS-SAN. The spindle 7 comprises a tip 7A which is tapered up to its end and is preferably conical and can be engaged with the recess 4C of the cosmetic holder 4. A portion 7B adjoins the tip 7A and is surrounded by the arms 4D of the cosmetic holder 4 when they are braced radially. Thus, in particular an axial friction locking or preferably a positive locking is given. On a further preferred embodiment, the portion 7B has a part of a spherical surface which is surrounded by the ends of the arms 4D which are preferably shaped like segments of spheres. Below the portion 7B at least one spiral groove is designed on the outer periphery of the spindle, wherein the outer contour of the spiral groove can be engaged with the claws 6F of the thread segment and interacts therewith. The pitch of the spiral groove should be self-locking even under the load of the spring 9. A further section 7D can also adjoin the section with the spiral groove 7C, said further section guiding the spring between the clamping piece 8 and the spindle base 7E on the lower end of the spindle 7. The periphery of the spindle base 7E has a diameter which should not be greater than the diameter 10C of the tube 10, so that the spindle can be placed into the area of the diameter 10C of the tube 10 and can be shifted axially. Grooves, 7F are arranged in an axial direction at the periphery of the spindle base 7E which interact with the webs 10D of the tube 10, whereby rotation of the spindle 7 in relation to the tube 10 should be prevented.

Figure 13:
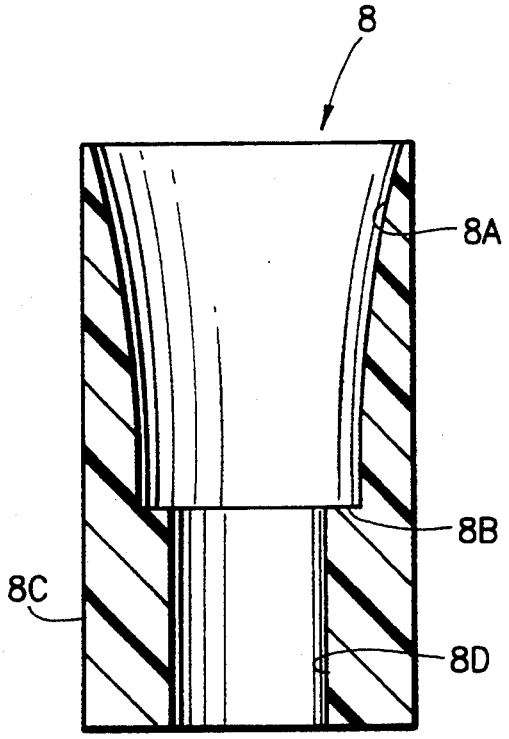
FIG. 13 shows a longitudinal section which is not to scale of a clamping piece of the pencil base according to FIG. 1.

FIG. 13 shows the clamping piece 8 which is preferably made of the plastic ABS-Reg. The clamping piece 8 comprises a recess 8A which narrows downwards, i.e. towards the inside of the clamping piece 8, and is preferably rotationally symmetrical. The recess 8A is tapered downwards so that it preferably forms a spherical surface. The upper inner diameter is so great that when the pencil base 1 and the replaceable part 2 are put together at least a part of the outer surface of the segment arms 6E of the thread segment engage with the recess 8A such that when the thread segment 6 is pushed axially into the clamping piece 8 the free ends of the arms 6E are guided by the inner surface of the recess 8A and are elastically braced inwards in a radial direction. The recess 8A essentially extends over somewhat more than half-way along the clamping piece 8 and is tapered towards the lowest inner diameter which is so small that the segment arms 6E of the thread segment 6 engage with one or several spiral grooves 7C of the spindle 7. A bore 8D adjoins the recess 8A downwards continuously, said bore 8D having a diameter which is essentially greater than the outer diameter of the spindle 7 with the spiral groove 7C. Furthermore, the clamping piece 8 has an outer diameter 8C which is smaller than or identical to the diameter 10C of the tube 10. Thus, the clamping piece can be placed into the area of the diameter 10C of the tube 10, preferably up to the end of the webs 10D.

In the following, the assembly of the pencil base or the replaceable part 2 will be described in detail, whereby the steps of the assembly can also be carried out in a different order.

A preferably cylindrical pressure spring 9 is placed over the tip 7A and the portion 7B of the spindle until one end of the spring rests on the base 7E of the spindle 7. The spindle 7 and the spring 9 are subsequently inserted, with the spindle base 7E at the front, through the open end of the tube 10 up to the closed end of the tube, wherein the grooves 7F engage in the spindle base 7E around the webs designed in the tube 10D. The clamping piece is then fitted through the open end of the tube 10 over the tip 7A and the portion 7B of the spindle into the tube 10 in the section of the diameter 10C of the tube up to the end of the webs 10D by means of a transition or interference fit.

On the replaceable part 2, the pencil-shaped cosmetic is pressed into the open end 4A of the pencil holder 4 and held by it. With the free end of the cosmetic at the front, the cosmetic 3 with the cosmetic holder 4 is then inserted into the cosmetic guide 5 through the bore 5E. The combination of both elements is inserted into the cosmetic guide 5 until the unstressed arms 4D of the cosmetic holder 4 rest at the transition region of the bore 5E to the bore 5C of the cosmetic guide 5. The thread segment is then inserted with its outer diameter 6C at the front into the bore 5E of the cosmetic guide until the projections 5F of the cosmetic guide 5 engage into the indentations 6B of the thread segment 6 and thus fix the elements 5,6 in a non-positive or positive fit such that they cannot be rotated.

When the replaceable part 2 and the pencil base 1 are assembled the diameter 5D of the cosmetic guide 5 is guided into the open end of the tube. The segment arms 6E of the thread segment 6 when they are not elastically braced extend over the tip 7A and the portion 7B of the spindle 7. When assembling the replaceable part and the pencil base 1 further, several operations preferably occur simultaneously. Firstly, the segment arms 6E of the thread segment 6 are moved through the recess 8A of the clamping piece 8 coaxially to the spiral groove 7C of the spindle 7 until they engage therewith. Furthermore, the tip 7A is pressed into the recess 4C of the cosmetic holder 4 and presses this upwards together with the cosmetic until the arms 4D move through the narrowing of the diameter 5C of the cosmetic guide 5 radially to the portion 7B of the spindle until they encompass this, preferably in a positive fit. The free end of the cosmetic 3 can project slightly through the bore 5A of the cosmetic guide 5. When the replaceable part and the pencil base 1 are completely assembled, the groove 10E in the diameter 10B of the tube 10 surrounds the bead 5G of the cosmetic guide 5 and fixes the replaceable part 2 onto the pencil base 1 in a non-positive or positive fit.

When the cosmetic guide 5 is rotated against the tube 10, the spindle is moved upwards by the thread segment 6 and the spiral groove 7C of the spindle or towards the tip of the cosmetic guide 5. The cosmetic can be pushed out until the outer diameter of the open end 4A of the cosmetic holder 4 is completely located in the bore 5A at the tip of the cosmetic guide 5. When the pencil base 1 and the replaceable part 2 are dismantled, the spindle 7 pulls the cosmetic holder downwards over the portion 7B, i.e. away from the tip of the cosmetic guide 5, until the arms 4D of the cosmetic holder 4 can relax in the bore 5E of the cosmetic guide 5 and thus release the portion 7B in the spindle.

I claim:

1. A cosmetic pencil comprising:

a) a pencil base (1) with a1) a tube (10), a2) a spindle (7), having a tip (7A), and a3) a spring (9) which is arranged on the spindle (7) and the tube (10) such that the spindle (7) is biased rearwardly against the pencil base, and b) a replaceable part (2) with b1) a cosmetic guide (5), which is essentially tubular, and b2) a cosmetic holder (4), at one end of which a bar-shaped cosmetic (3) can be attached and which can be shifted axially in the cosmetic guide (5), c) wherein the pencil base (1) and the replaceable part (2) can be coupled such that they can be rotated in opposite directions and the cosmetic holder (4) can be pushed away from the tip (7A) of the spindle (7), characterized in that the pencil base (1) further comprises a4) a spiral means (7C) which is located on an outer periphery of the spindle (7), a5) an undercut spherical portion (7b) adjoining tip (7A) on the spindle (7), and a6) a clamping means (8) having a narrowing surface (8A), and the replaceable part (2) further comprises b3) a gripping means (6) having at least one radial elastic arm (6E) with a claw (6F) at a free end of the arm, b4) a locking means on another end of the cosmetic holder (4), said locking means provided with radial elastic arms (4D), and b5) the cosmetic guide (5) comprises a first section with a first diameter (5E) and a second section with a second, smaller diameter (5C), d) wherein the gripping means (6) can only be radially engaged with the spiral means (7C) of the spindle (7) when the pencil base (1) and the replaceable part (2) are coupled, and when the pencil base (1) and the replaceable part (2) are coupled the radial elastic arm (6E) slides axially on the narrowing surface (SA) of the clamping means (8) and is elastically braced radially and the claw (6F) engages with the spiral means (7C) of the spindle (7) and the free end of the radial arms (4D) of the locking means surrounds the undercut portion (7b) of the spindle (7).

2. Cosmetic pencil according to claim 1, characterized in that the gripping means (6) is arranged on the cosmetic guide (5).

* * * * *